United States Patent [19]

Fay et al.

[11] Patent Number: 4,457,323

[45] Date of Patent: Jul. 3, 1984

[54] DISHWASHER WITH STEAM GENERATING HEATER AND COLD WATER INPUT

[75] Inventors: John A. Fay; Cyral M. Walsh; Venancio Ko, all of Los Angeles County, Calif.

[73] Assignee: Norris Industries, Los Angeles, Calif.

[21] Appl. No.: 367,744

[22] Filed: Apr. 12, 1982

Related U.S. Application Data

[60] Continuation of Ser. No. 99,645, Dec. 3, 1979, abandoned, which is a division of Ser. No. 8,951, Feb. 2, 1979, Pat. No. 4,246,916.

[51] Int. Cl.[3] ..... B08B 7/04

[52] U.S. Cl. ..... 134/18; 134/25.2; 134/30; 422/26; 422/105

[58] Field of Search ..... 134/25.2, 30, 29, 105, 134/18; 422/26, 106, 105

[56] References Cited

U.S. PATENT DOCUMENTS

| | | | |
|---|---|---|---|
| 2,919,070 | 12/1959 | Arant | 134/30 |
| 3,049,133 | 8/1962 | Jacobs | 134/30 |
| 3,049,450 | 8/1962 | Koons et al. | 134/30 |
| 3,072,128 | 1/1963 | James | 134/30 |
| 3,207,164 | 8/1965 | Fay | 134/105 |
| 3,361,517 | 1/1968 | Skaller | 422/26 |
| 4,070,204 | 1/1978 | Hardy et al. | 134/25.2 |
| 4,246,916 | 1/1981 | Fay et al. | 134/105 |

*Primary Examiner*—Ferris H. Lander

*Attorney, Agent, or Firm*—Harris, Kern, Wallen & Tinsley

[57] ABSTRACT

A dishwasher and dishwashing method which generate steam from the surface of a body of water in the dishwasher tub, without substantial heating of the entire body of water, during at least parts of the washing and rinsing operations performed on dishes within the tub. Heating only a surface layer of the body of water to generate steam results in substantial energy savings, particularly when the dishwasher is supplied with cold water, instead of preheated water. Efficient steam generation, and heating limited to the surface layer of the body of water, are achieved by utilizing a large-area partially-submerged electric heater, comprising an electrical resistance heating element carrying a heat conductive, metallic jacket of enlarged cross section. The jacket is provided with a depending peripheral skirt for trapping air and/or steam beneath the jacket so as to minimize downward heat transfer from the jacket to the water below the surface layer.

2 Claims, 6 Drawing Figures

DISHWASHER WITH STEAM GENERATING HEATER AND COLD WATER INPUT

This application is a streamline continuation of application Ser. No. 099,645, filed Dec. 3, 1979, and now abandoned, which was a division of application Ser. No. 008,951, filed Feb. 2, 1979, now U.S. Pat No. 4,246,916, issued Jan. 27, 1981.

BACKGROUND OF INVENTION

The present invention relates in general to dishwashers, particularly household dishwashers, and, more specifically, to a dishwasher having means for generating steam within the dishwasher tub during at least parts of the washing and rinsing operations performed on dishes being washed, rinsed and dried within the tub.

Preferably, the dishwasher of the invention utilizes an electric heater or heating system having the characteristics disclosed and claimed in U.S. Pat. No. 3,207,164, issued Sept. 21, 1965 to John A. Fay, one of the inventors named in the present application.

OBJECTS AND SUMMARIES OF INVENTION

The invention may be summarized as comprising, and the primary object of the invention is to provide, a dishwasher and dishwashing method which generates steam from the surface of a body of water in the bottom of the tub of the dishwasher, without substantial heating of the entire body of water, during at least parts of the washing and rinsing operations performed on dishes within the tub.

Another important object of the invention is to provide a dishwasher and method which utilize cold inlet water, instead of preheated water, i.e. which utilize unheated water from conventional cold water sources.

Heating only a surface layer of the body of water to generate steam results in subtantial energy savings, particularly when the dishwasher is supplied with cold water, instead of preheated water, which is an important feature of the invention. Restricting heating for steam generating purposes to a surface layer requires only about 60% as much energy with cold inlet water, another important feature.

The invention may be further summarized as including, and still another important object is to provide, a method of generating steam within a dishwasher tub adapted to be filled with a body of water to a predetermined static water level, without substantial heating of the entire body of water, including the step of applying heat to the body of water only at and slightly below the surface thereof to heat to a substantial extent only a surface layer of the body of water, thereby boiling water from such surface layer in the region to which heat is applied to generate steam in the dishwasher tub, without any substantial heating of the body of water below the surface layer.

The invention may be still further summarized as comprising, and yet another important object is to provide, a dishwasher which includes a tub adapted to contain dishes to be washed, rinsed and dried and adapted to be filled with a body of water to a predetermined static water level, and an electrical resistance heating means exposed to the interior of the tub adjacent to the bottom thereof and disposed partly above and partly below the static water level in the tub when it contains water to the static level, whereby the heating means boils water from the surface of the body of water in the tub to produce steam within the tub during washing and/or rinsing of dishes therein, without any substantial heating of the water below the surface layer.

As previously pointed out, the foregoing dishwasher and method achieve the desired steaming of dishes during at least parts of the washing and rinsing operations with only insubstantial heating of the body of water below the surface layer, thereby producing substantial energy savings, particularly with cold inlet water.

Efficient steam generation, and heating limited essentially to the surface layer of the body of water, are achieved by utilizing a large-area partially-submerged electric heater comprising an electric resistance heating element carrying a heat conductive jacket of enlarged cross-section, which is another important object of the invention.

A further object is to provide the jacket with a depending peripheral skirt for trapping air and/or steam beneath the jacket to provide an insulating layer for minimizing downward heat transfer from the jacket to the water below the static water level. This feature assists in minimizing any substantial heating of the body of water below the surface layer.

An additional object is to provide the heat conductive jacket on the heating element with projecting ribs, or the like, for further improving heat transfer to the surface layer of the body of water.

A still further object of the invention is to provide an operating cycle for a dishwasher which includes the steps of washing the dishes at least in part by heating only a surface layer of the body of water in the tub sufficiently to generate steam, rinsing the dishes at least in part by heatng only the surface layer of the body of water sufficiently to generate steam, and subsequently drying the dishes by applying heated air thereto.

Yet another object is to provide an operating cycle of the foregoing nature which involves preliminarily rinsing the dishes, after washing thereof, one or more times with cold water, thereby minimizing energy requirements, the dishes subsequently being rinsed at least once with steam and/or hot water obtained by heating only a surface layer of the body of water in the tub prior to drying the dishes with heated air.

The foregoing objects, advantages, features and results of the present invention, together with various other objects, advantages, features and results which will be evident to those skilled in the dishwasher art in the light of this disclosure, may be achieved with the exemplary of the embodiments of the invention illustrated in the accompanying drawings and described in detail hereinafter.

DETAILED DESCRIPTION OF EXEMPLARY EMBODIMENTS OF INVENTION

Figure 1:
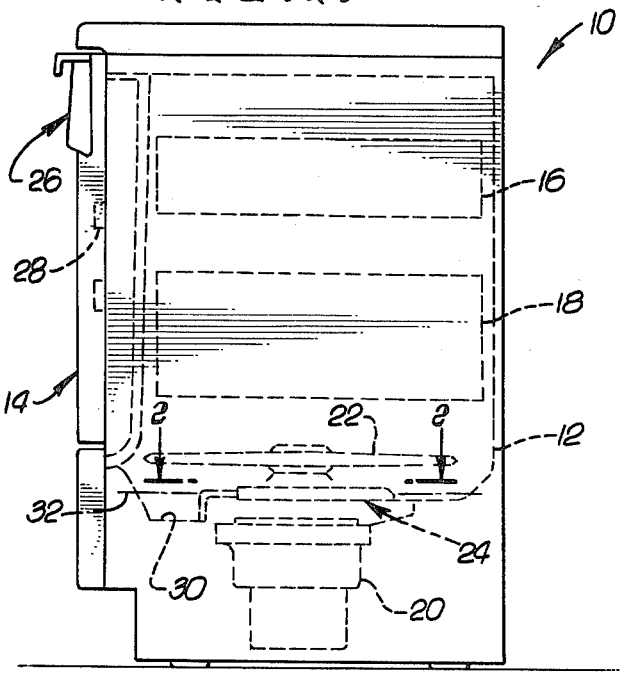
FIG. 1 is a side elevational view of a front loading household dishwasher which embodies the invention.
Figure 3:
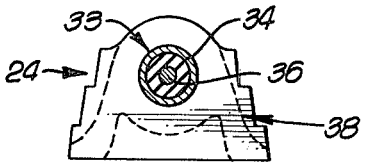
FIGS. 3 and 4 are further enlarged, sectional views respectively taken as indicated by the arrowed lines 3—3 and 4—4 of FIG. 2.
Figure 4:
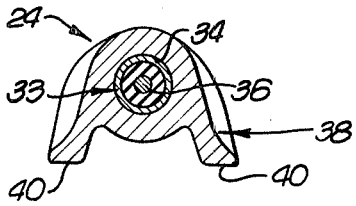
Figure 2:
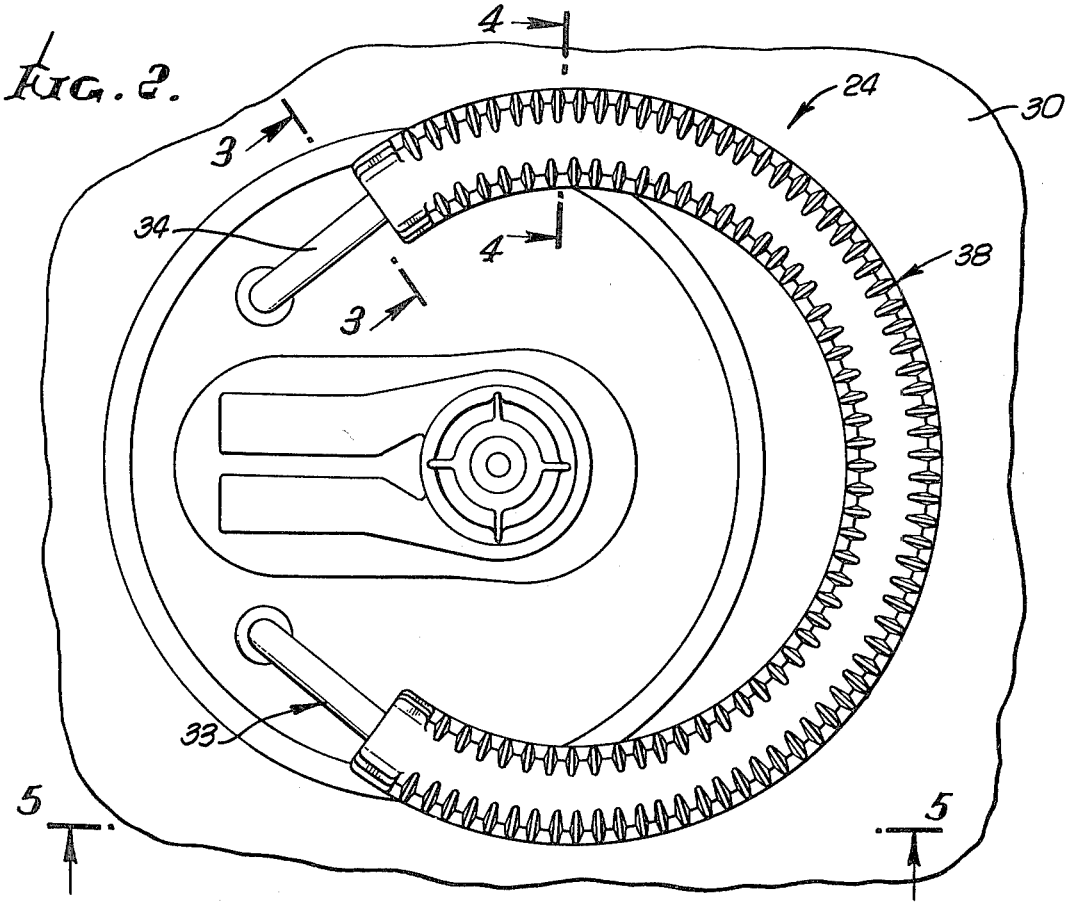
FIG. 2 is an enlarged plan view of an electrical resistance heating means of the invention, taken as indicated by the arrowed line 2—2 of FIG. 1.

Referring initially to FIG. 1 of the drawings, the dishwasher of the invention is designated generally by the numeral 10 and is shown for purposes of illustration as including a tub 12 provided with a downwardly-opening front door 14. Dishes to be washed, rinsed and dried within the tub 12 are adapted to be supported therein by racks 16 and 18 accessible upon opening the front door 14. As will be described, during parts of the operating cycle of the dishwasher 10, water is drawn from the bottom of the tub 12 by a motor-pump assembly 20 and is delivered to a water distributing impeller 22 which sprays the water over dishes in the racks 16 and 18. If desired, a second impeller, not shown, in series with the impeller 22 may be located between the racks 16 and 18.

An electrical resistance heater or heating means 24 is located within the tub 12 adjacent the bottom thereof and in communication with the interior of the tub, being suitably mounted on the bottom wall of the tub.

The structure of the dishwasher 10 has been illustrated and described in a superficial way only merely to outline the environmental setting of the invention. It will be understood that the dishwasher 10 includes numerous additional components, preferably electrically operated, for performing such functions as introducing water into the tub 12 at various times during the operating cycle of the dishwasher, for draining the water from the tub after each washing or rinsing operation, for circulating heated air over dishes in the racks 16 and 18 during the drying operation, and the like. These various operations are carried out under the control of a timer 26 located at the top of the door 14 in the particular construction illustrated, and a thermostat 28 located in the door and exposed to the temperature within the tub. The various electrically operated components of the dishwasher 10, and their control elements, may be connected in a conventional manner which is well known in the household dishwasher art, a simplified illustrative example being shown in the aforementioned Fay patent. Consequently, a detailed description herein is not necessary.

The heater 24 is mounted on the bottom wall of the tub 12 within a sump 30 from which water is drawn by the motor-pump combination 20 when it is in operation, either to deliver water to the impeller 22, or to drain water from the tub. An important feature of the invention is that the heater is only partially submerged in a body of water in the sump 30 when such body of water is static. In other words, the heater 24 is partially above and partially below the surface of the static body of water, the static water level being designated by the numeral 32.

The heating means or heater 24 includes a heating element 33 comprising a sheath 34 containing electrical insulating material in which is embedded a resistance heating element 36 having a high temperature coefficient of resistance, as disclosed in more detail in the Fay patent hereinbefore mentioned. Consequently, a further explanation herein is not necessary.

The heating element 33 is encased throughout most of its length by a heat conductive jacket 38 of enlarged cross-section, which jacket may be formed of a metal like aluminum. To improve heat conductivity, the jacket is preferably a dense casing bonded to the sheath 34, such as a die casting. As will be apparent from FIG. 5 in particular the jacket 38 is only partially submerged in the static body of water, i.e., it is disposed partially above and partially below the static water level 32.

Figure 5:
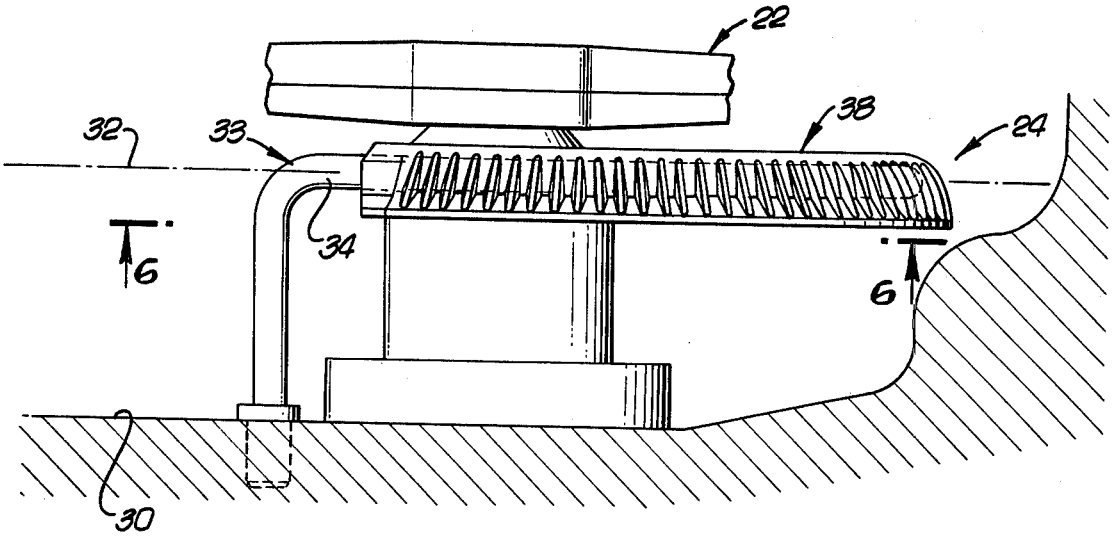
FIG. 5 is a side elevational view of the electrical resistance heating means or heater of the invention.
Figure 6:
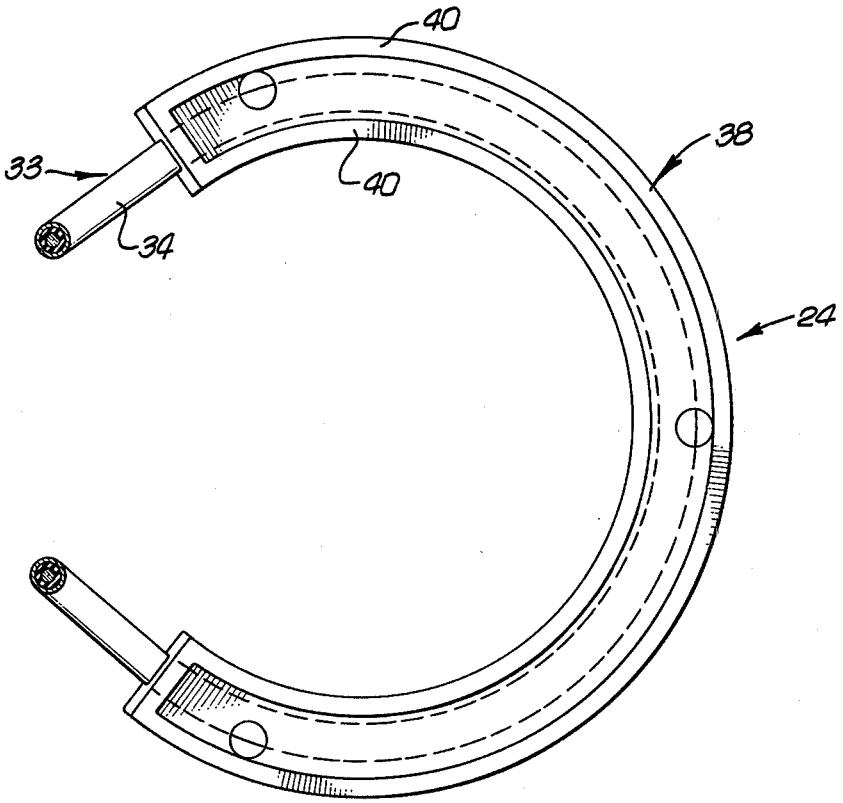
FIG. 6 is a bottom plan view taken as indicated by the arrowed line 6—6 of FIG. 5 of the drawings.

To improve heat conductivity to the body of water in which the heater 24 is partially submerged, the jacket 38 is externally ribbed, as will be clear from FIG. 5, for example. To minimize downward transfer of heat to the body of water below a relatively thin surface layer, the jacket 38 is provided with a depending peripheral skirt 40 for trapping air and/or steam beneath the jacket, thus forming an insulating air and/or steam layer beneath a major portion of the jacket bottom. It will be understood that the skirt 40 extends all the way around the bottom of the jacket 38, as will be clear from FIG. 6 in particular.

OPERATION OF HEATER 24

As will be understood from the foregoing, when the bottom of the tub 12 contains a static body of water to the level 32, the jacket 38 is only partially submerged and applies heat only to a surface layer of a body of water, there being no substantial application of heat to the water below such surface layer, due in large part to the air and/pr steam insulation layer trapped within the depending skirt 40 at the bottom of the jacket. Consequently, efficient steam generation, and heating limited to the surface layer of the body of water, are achieved with the invention, due to the partially submerged jacket 38, its large surface area, and the insulating layer formed by trapped air and/or steam within the skirt 40.

As will be discussed in more detail hereinafter, the heater 24 is used for steam generation only, with a static body of water in the tub 12 to the level 32, during at least parts of washing and rinsing operations performed on the dishes. Utilizing the heater 24 for steam generation in this manner results in heating a surface layer of the body of water to a high temperature, with no substantial heating of the body of water below the surface layer, which is an importatnt feature, since as hereinbefore indicated, substantial energy savings result. Another important feature is that when the body of water is subsequently agitated, during delivery to the impeller 22, or to drain, the hot surface layer and the lower temperature water therebeneath are mixed to elevate the average temperature of the water in the tub to a high enough value to keep any grease removed from the dishes in suspension.

It is important to more from the foregoing that the desired efficient steam generation is achieved by heating only the surface layer of the body of water to a high temperature, and that the high average temperature of the body of water during subsequent agitation, necessary to keep grease in suspension, is achieved without heating the entire body of water to the high level necessary for steaming.

It will be further understood that steaming of the dishes with a quiescent body of water in the foregoing manner is preferably carried out during only parts of the washing and rinsing operations of the total operating cycle, such steaming operations promoting effective washing and rinsing of the dishes by "soaking" them in steam. The total operating cycle also includes spraying operations during washing and rinsing by way of the impeller 22, some being subsequent to the steam operations, and others being in addition thereto. Operating cycles of the invention will now be described.

HOT WATER OPERATING CYCLE

The operating cycle which will now be considered involves the use of hot, i.e., preheated, water for each of six fillings of the tub 12 to the static water level 32. In these six steps, the same amounts of hot water are used.

As the first step, the dishes are subjected to a spray washing operation with a detergent, this being a timed step under the control of the timer 26. The second step involves a steaming operation, under the control of the thermostat 28, followed by a spraying operation through the impeller 22, no detergent being added for this step. The third step involves timed steaming of the dishes with a detergent added, followed by a timed spraying operation. The fourth and fifth steps involve timed spray rinses, while the sixth and final step involves a thermostat-controlled steam operation followed by a spraying operation, with a rinsing agent added.

COLD WATER OPERATION

As earlier indicated, the dishwasher 10 of the invention may be operated effectively and efficiently utilizing cold input or inlet water, i.e., water which has not been preheated in a conventional water heater. The cold water operating cycle which will now be described involves seven steps. The first, second, third and seventh steps involve filling the rub 12 with cold water to the static water level 32. The fourth, fifth and sixth steps, which, as will be explained, are rinsing steps, involve filling with only about ¾ of the quantity of water required to reach the static water level 32.

The first step, a washing step, involves thermostatically-controlled steaming of the dishes with a detergent added, followed by spray washing of the dishes with the same water. It will be understood of course that the steaming is achieved by heating primarily the surface layer of the body of cold water introduced into the tub 12.

The second step involves timed steaming of the dishes followed by spraying with the impeller 22, no detergent being added.

The third step involves thermostatically-controlled steaming followed by spray washing, with a detergent added.

The fourth, fifth and sixth steps are all spray rinsing operations utilizing cold water, there being no heating of the water. These three partial-fill rinsing operations achieve effective dilution of any redeposition of waste matter on the dishes, with a minimum of water, and without any necessity for expending energy in heating.

The seventh step involves thermostatically-controlled steaming of the dishes followed by a spray rinsing operation, with a rinsing agent added to sheet off the water.

Subsequently to the foregoing, of course, the dishes are dried with heat from the heater 24 in the usual manner.

Utilizing cold input water during the foregoing four steps in which the cold water is heated, while utilizing unheated cold water in the three cold-water rinsing steps discussed, requires only about 60% as much energy as conventional hot water dishwashers, which is an important saving. Further, during the four steps in which the cold inlet water is heated for steaming purposes, the effect of a dish temperature of about 155° F. is achieved with an over-all or average water temperature of only 110° F. to 120° F., assuming a 55° F. water input, which results in energy savings of the magnitude indicated.

Although exemplary embodiments of the invention have been disclosed herein for purposes of illustration, it will be understood that various changes, modifications and substitutions may be incorporated in such embodiments without departing from the invention as hereinafter claimed.

We claim as our invention:

1. A method of generating steam within a dishwasher tub having a horizontally disposed electric heater therein, without any substantial heating of the entire body of water, including the steps of:

filling the tub to a preselected static water level such that the electric heater is partially submerged in the water and partially exposed in the air above the water;

applying heat to the body of water by energizing the partially submerged electric heater to heat a layer of the body of water at the surface thereof, thereby boiling water from such surface layer to generate steam which is immediately released to the air in the tub without moving up through the water; and terminating the application of heat to the body of water when the temperature at a predetermined location within the tub above the static water level is raised to a predetermined value.

2. A method of generating steam within a dishwasher tub having a horizontally disposed electric heater therein, without any substantial heating of the entire body of water, including the steps of:

filling the tub to a preselected static water level such that the electric heater is partially submerged in the water and partially exposed in the air above the water;

applying heat to the body of water by energizing the partially submerged electric heater, thereby boiling water from the surface to generate steam which is immediately released to the air in the tub without moving up through the water; and terminating the application of heat to the body of water when the temperature at a predetermined location within the tub above the static water level is raised to a predetermined level.

* * * * *

UNITED STATES PATENT AND TRADEMARK OFFICE

CERTIFICATE OF CORRECTION

PATENT NO. : 4,457,323

DATED : July 3, 1984

INVENTOR(S) : John A. Fay; Cyral M. Walsh; Venancio Ko

It is certified that error appears in the above-identified patent and that said Letters Patent is hereby corrected as shown below:

Please change at column 4, line 25 "pr" to --or--

Please change at column 4, line 49 "more" to --note--

Please change at column 5, line 29 "rub" to --tub--

Signed and Sealed this

*Eleventh* Day of *December 1984*

[SEAL]

*Attest:*

GERALD J. MOSSINGHOFF

*Attesting Officer* *Commissioner of Patents and Trademarks*